United States Patent [19]

Treftc et al.

[11] 3,999,624

[45] Dec. 28, 1976

[54] ACOUSTICAL ATTENUATING DEVICE

[76] Inventors: Chester F. Treftc, Rte. 2, Box 254E, Salem, Wis. 53168; James H. Harris, Rte. 2 Box 236, Union Grove, Wis. 53182

[22] Filed: Apr. 5, 1974

[21] Appl. No.: 458,109

[52] U.S. Cl. ..... 181/57; 181/47 R

[51] Int. Cl.[2] ..... F01N 1/08

[58] Field of Search ..... 181/35 R, 36 R, 10, 181/33 R, 41, 47 R, 47 B, 47 A, 57 R, 64 R, 64 A

[56] References Cited

UNITED STATES PATENTS

| | | | |
|---|---|---|---|
| 753,845 | 3/1904 | Brockway | 181/57 |
| 1,023,225 | 4/1912 | Shlosberg | 181/57 |
| 1,024,688 | 4/1912 | Lewis | 181/57 |
| 1,059,279 | 4/1913 | Cottrell | 181/36 B |
| 1,155,757 | 10/1915 | Rapp | 181/57 |
| 1,264,853 | 4/1918 | Phyfe | 181/57 |
| 1,487,312 | 3/1924 | Bull | 181/47 R |
| 2,933,148 | 4/1960 | Hendry | 181/47 A |

FOREIGN PATENTS OR APPLICATIONS

| | | | |
|---|---|---|---|
| 793,373 | 1936 | France | 181/47 |
| 1,441,401 | 3/1962 | France | 181/47 |
| 123,337 | 10/1900 | Germany | 181/60 |
| 641,780 | 11/1934 | Germany | 181/60 |
| 562,992 | 1957 | Italy | 181/57 |
| 155,261 | 1922 | United Kingdom | 181/47 R |
| 516,061 | 1939 | United Kingdom | 181/57 |

*Primary Examiner*—L. T. Hix
*Assistant Examiner*—Vit W. Miska
*Attorney, Agent, or Firm*—Edward C. Threedy

[57] ABSTRACT

A pneumatic muffler providing within the cavity formed by its conical-like shell a proportionate expansion chamber in immediate communication with an exhaust port and an integrally related quiescent chamber reducing in volume for cushioning the introduced volume of exhaust so as to convert the same into a passive modulated acoustical pressure wave, which is then exhausted into the ambient atmosphere.

5 Claims, 3 Drawing Figures

ACOUSTICAL ATTENUATING DEVICE

SUMMARY OF THE INVENTION

The device is directed to a muffler readily adapted to exhaust systems of pneumatically operated equipment, as well as internal combustion engines, with the device consisting of a conical-like shell having a first frusto-conical body portion consisting of diverging walls forming an expansion chamber circumscribing an inlet port. A cone section is connected to the frusto-conical body portion and provides converging walls forming a cushion chamber which functions as a quiescent zone which becomes progressively restrictive in area in relation to its depth in proportion to the distance from the inlet port of the device. A common base wall lies at the junction between the frusto-conical body portion and the cone and defines a total circular area of the device in which the periphery is provided with a plurality of beveled ports through which the passive modulated acoustical pressure waves are exhausted from the device into the ambient atmosphere.

The invention will be best understood by reference to the accompanying drawings, in which there is shown the preferred form of the device and in which.

Figure 1:
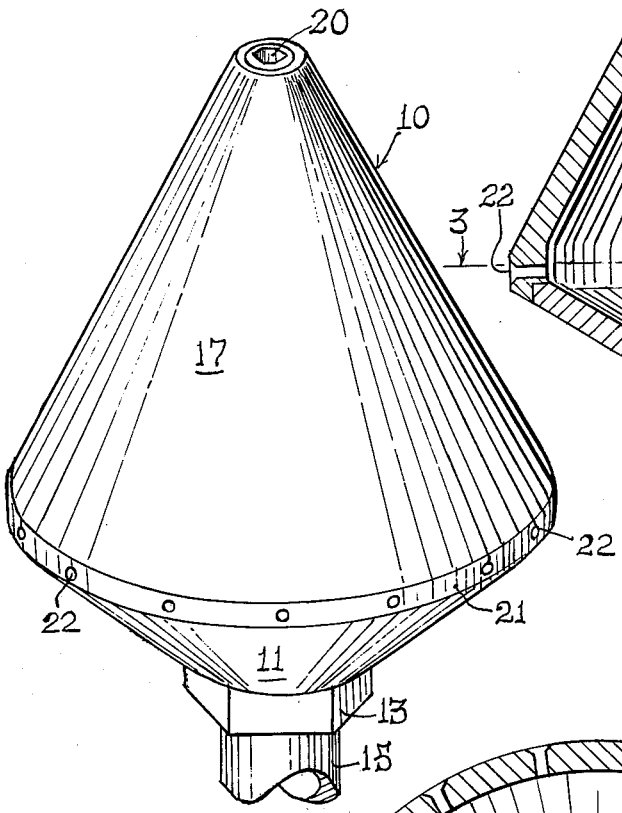
FIG. 1 is a perspective view of the muffler type device.

The acoustical attenuating device of this invention comprises a conical-like shell 10 which includes a frusto-conical body portion 11 which consists of a wall 12 which extends in a diverging direction from a circular enlarged fitting 13 centrally positioned with respect to the wall 12. The circular fitting 13 has an internal threaded bore 14 which is adapted to threadably receive the free end 15 of an exhaust.

Figure 2:
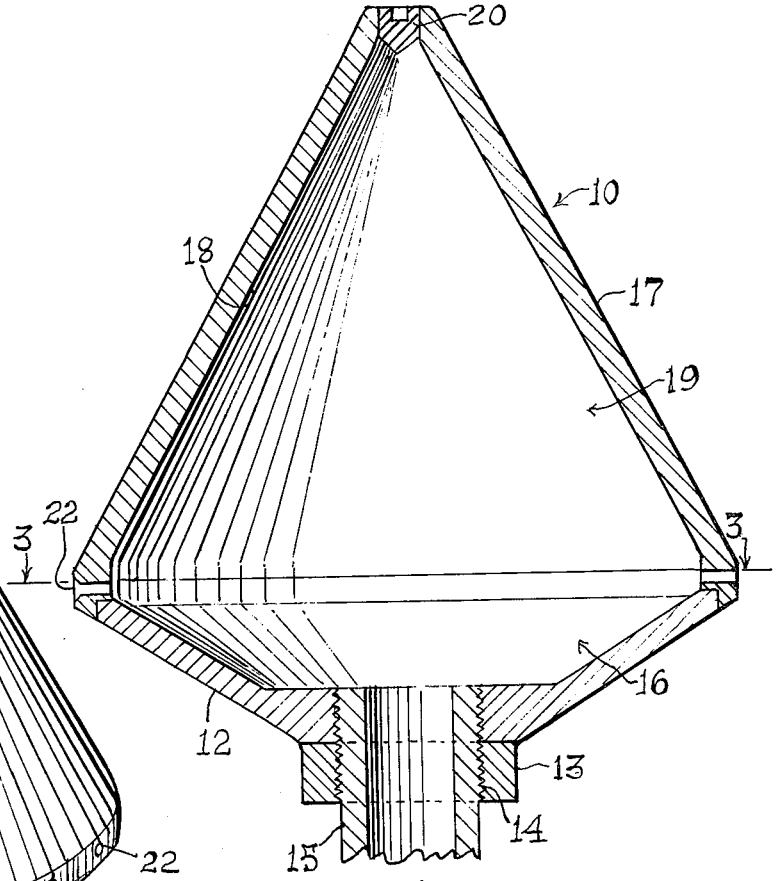
FIG. 2 is a detailed sectional view throughout the length of the device.
Figure 3:
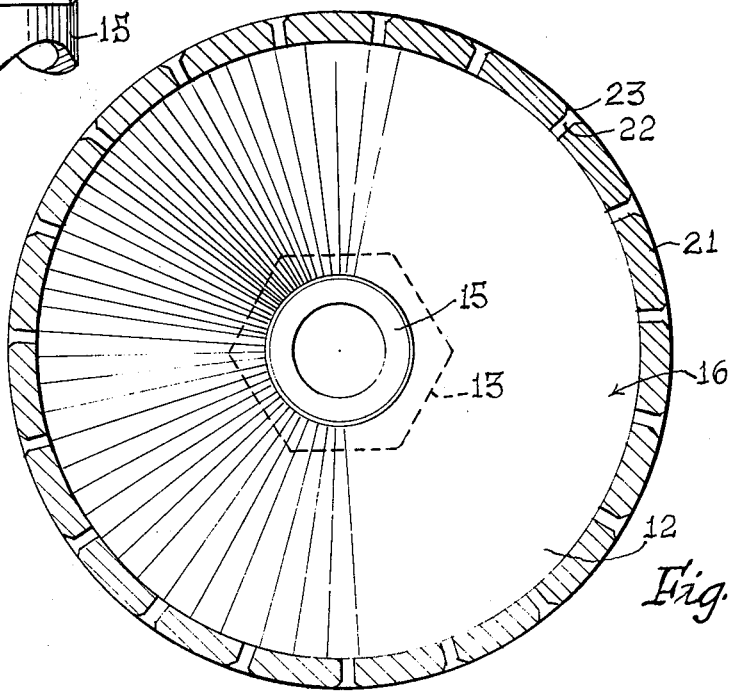
FIG. 3 is a detailed sectional view taken on line 3—3 of the device as shown in FIG. 2.

The diverging wall 12 forms an expansion chamber 16 circumscribing the threaded internal bore 14 of the enlarged fitting 13 as shown in FIGS. 2 and 3.

A cone 17 is connected to the frusto-conical body portion 11 and provides a wall 18 converging in the direction of its length so as to form a cushion chamber or quiescent zone 19 which is progressively restricted in area in relation to its length. The tip of the cone 17 may be closed by an integral structure or by a clean-out plug 20 as shown.

A common base wall 21 is formed at the junction between the edges of the diverging wall 12 of the frusto-conical body portion 11 and the free peripheral edge of the cone 17 and circumscribes a total internal circular area of the shell 10.

Formed throughout the periphery of the base wall 21, are a plurality of exhaust ports 22. These exhaust ports 22 have their exposed ends beveled as at 23, as clearly shown in FIG. 3, so as to assist in exhausting or disbursement of the acoustical pressure waves therethrough into the ambient atmosphere about the shell 10.

In operation the exhaust from the working apparatus to which the device is attached is caused to pass through the exhaust system 15 into the interior of the shell 10 with a free flaring motion extending through the expansion chamber 16. This exhaust consists of acoustical pressure waves which may be classified as positive, in that they have obtained a vibrational motion causing an objectionable noise.

As the positive acoustical pressure waves flow through the expansion chamber 16, they will strike the converging wall 18 of the cone 17 which will function as acoustical impedence to their direction of motion and reflect the positive pressure waves in the direction of the periphery of the expansion chamber 16, which is the total area defined by the common base wall 21. Certain of the positive pressure waves will progress further into the depth of the cone 17, striking the coverging walls with a lesser force, thus producing a slower reflective flow in the direction of the expansion chamber 16 along the tapered wall 18 of the cone 17, to become passive pressure waves or negative acoustical pressure waves. Some of the pressure waves which accumulate in the base of the cone 17 will function as a cushion against any continuing projection of positive acoustical waves, so as to absorb some of the vibrations thereof and effectively change them into passive acoustical waves.

Thus, the area within the cone 17 becomes a quiescent zone and dampens the positive acoustical pressure waves until they can proceed along the wall 18 in a reflective or return direction so as to be received in the total circular area of the shell 10, at which time they will be exhausted through the ports 22 and absorbed into the surrounding ambient atmosphere.

The specific shape of the device resulting from the frusto-conical body portion and cone provides an excellent noise reducer without the usual use of porous filters which have a tendency to increase back pressure through the exhaust system and effect loss of power through the associated equipment.

The device of this invention has been tested in numerous applications and it has been found that the noise reduction runs from 15 to 35 dba, all well within the acceptable noise level.

While we have illustrated and described the preferred form of construction for carrying our invention into effect, this is capable of variation and modification without departing from the spirit of the invention. We therefore do not wish to be limited to the precise details of construction set forth, but desire to avail ourselves of such variations and modifications as come within the scope of the appended claims.

Having thus described our invention, what we claim as new and desire to protect by Letters Patent is:

1. An acoustical attenuating device adapted to be connected to the exhaust of a noise-producing apparatus comprising a. a substantially conical shaped shell having an inlet port in communication with an exhaust outlet of the noise-producing apparatus, b. said shell including a frusto-conically shaped portion defined by a circular diverging wall circumscribing said inlet port that provides therein an open expansion chamber, c. a cone having an altitude greater than said expansion chamber with its converging wall forming a pneumatic cushion chamber having along its base open and unobstructed communication with said expansion chamber, d. means disposed coaxially of said inlet port for closing the tip of said cone, e. and exhaust ports disposed in the enlarged area of said conical shaped shell between said expansion chamber and said pneumatic cushion chamber through which the cushioned noise exhausts are exhausted into the surrounding ambient atmosphere.

2. The acoustical attenuating device as defined in claim 1 further defined as providing a circular base wall common to said expansion chamber defined by said circular diverging wall and said pneumatic cushion chamber formed by said cone, with said base wall defining the total circumference of said shell.

3. The acoustical attenuating device as defined in claim 1 wherein said exhaust ports are provided with beveled openings formed on the outside surface of said enlarged area for dispensing cushioned noise exhaust into the surrounding ambient atmosphere.

4. An acoustical attenuating device as defined by claim 2, wherein said exhaust ports are formed in said circular base wall so as to be disposed along the circumference of said shell.

5. An acoustical attenuating device as defined by claim 4, wherein said exhaust ports are provided with beveled openings formed on the outside surface of said circular base wall for dispensing cushioned noise exhaust into the surrounding ambient atmosphere.

* * * * *